US007089989B2

(12) United States Patent
Pfender

(10) Patent No.: US 7,089,989 B2
(45) Date of Patent: Aug. 15, 2006

(54) LIFTING FOLDING DOOR

(76) Inventor: Thomas E. Pfender, 3625 Rolling Rock Dr., Evansville, Vanderburgh County, IN (US) 47711

( * ) Notice: Subject to any disclaimer, the term of this patent is extended or adjusted under 35 U.S.C. 154(b) by 43 days.

(21) Appl. No.: 10/958,880

(22) Filed: Oct. 5, 2004

(65) Prior Publication Data

US 2005/0072537 A1 Apr. 7, 2005

Related U.S. Application Data

(60) Provisional application No. 60/508,594, filed on Oct. 6, 2003.

(51) Int. Cl.
*E05D 15/06* (2006.01)

(52) U.S. Cl. ..... 160/195; 160/207

(58) Field of Classification Search ..... 160/195, 160/203, 207, 209, 212, 213, 183
See application file for complete search history.

(56) References Cited

U.S. PATENT DOCUMENTS 1,833,252 A * 11/1931 Hayman ..... 160/190
1,893,263 A * 1/1933 Backes ..... 160/191
2,043,490 A * 6/1936 Redrup ..... 160/191
3,280,888 A * 10/1966 Davis ..... 160/35
3,618,656 A * 11/1971 Young ..... 160/9
3,757,845 A * 9/1973 Pagliaro ..... 160/189
4,871,007 A * 10/1989 Abolins ..... 160/201
5,002,114 A * 3/1991 Hormann ..... 160/229.1
6,148,895 A * 11/2000 Biggers ..... 160/183

* cited by examiner

*Primary Examiner*—David Purol
(74) *Attorney, Agent, or Firm*—Gary K. Price, Esq.

(57) ABSTRACT

A folding door apparatus for homes and other building structures that is formed of a plurality of panels hinged together in accordion fashion. The door panels are raised and lowered along parallel vertical rails by a pair of winding reels and cable. A stability pin and a plurality of guide pins extend from the outer side edge of selected panels. The rails are hinged to the structure's flooring, and define an inner and outer trackway. The inner trackway for receiving the stability pin, and the outer trackway for receiving the guide pins. The inner trackway further defines a release point at the approximate midway of the length of the rail. In application raising the door panels to an open position, the stability pin remains engaged within the inner railway until stability pin is raised to the release point. At release point the stability pin is disengaged from inner railway for proper folding of the panels.

19 Claims, 10 Drawing Sheets

LIFTING FOLDING DOOR

CROSS REFERENCES TO RELATED APPLICATIONS

U.S. Provisional Application for Patent No. 60/508,594, filed Oct. 6, 2003, with title "Lifting Folding Door" which is hereby incorporated by reference. Applicant claims priority pursuant to 35 U.S.C. Par. 119(e)(i).

Statement as to rights to inventions made under Federally sponsored research and development

BACKGROUND OF THE INVENTION

1. Field of the Invention

The present invention relates generally to a folding door apparatus in which a plurality of door panels are movable between an extended or unfolded position and a folded position relative to the opening in a building structure.

2. Brief Description of Prior Art

Prior art garage doors for homes and other building structures are built with several sections so they can be rolled up and stored overhead and move on a pair of rails so that the door moves from a vertical position to a horizontal position. Since the door when in the horizontal position has the same size as when it is in the vertical position it covers a large area of the ceiling and requires a large framework of tracks and straps.

The prior art further exemplifies various techniques for raising and lowering foldable door panels along vertical trackways. While the prior art relates to the broad concept of having adjacent panels connected to each other along horizontal edges for an accordian—type operation, the known arrangements are substantially complicated, are expensive to manufacture, and often require special hinging arrangements to withstand the forces associated with panel movement between extended and stacked positions.

As will be seen from the subsequent description, the preferred embodiments of the present invention overcome the above problems and difficulties of the prior art.

SUMMARY OF THE INVENTION

The present invention is directed to a folding door apparatus for homes and other building structures that is formed of a plurality of panels hinged together with alternate hinges being on the inner or outer side of the door. A stability pin and a plurality of guide pins extend from the outer side edge of selected panels. A cable extends vertically along the panels having a first end connected to the remotest panel from a reel, and an opposite end connected to the reel that is keyed to a drive shaft. The apparatus further includes a guiding system comprising a pair of vertical rails adjacently disposed to the structure's vertical uprights, and hinged to the structure's flooring. The rail defines an inner trackway or railway and an outer railway. The inner railway for receiving the stability pin, and the outer railway for receipt of the guide pins. The inner railway further defines a release point disposed at the approximate midway of the length of the rail.

In application raising the door panels to an open position, the stability pin remains engaged within the inner railway until stability pin is raised to the release point. At release point the stability pin is disengaged from inner railway for proper folding of the panels.

DESCRIPTION OF THE PREFERRED EMBODIMENT

Figure 1:
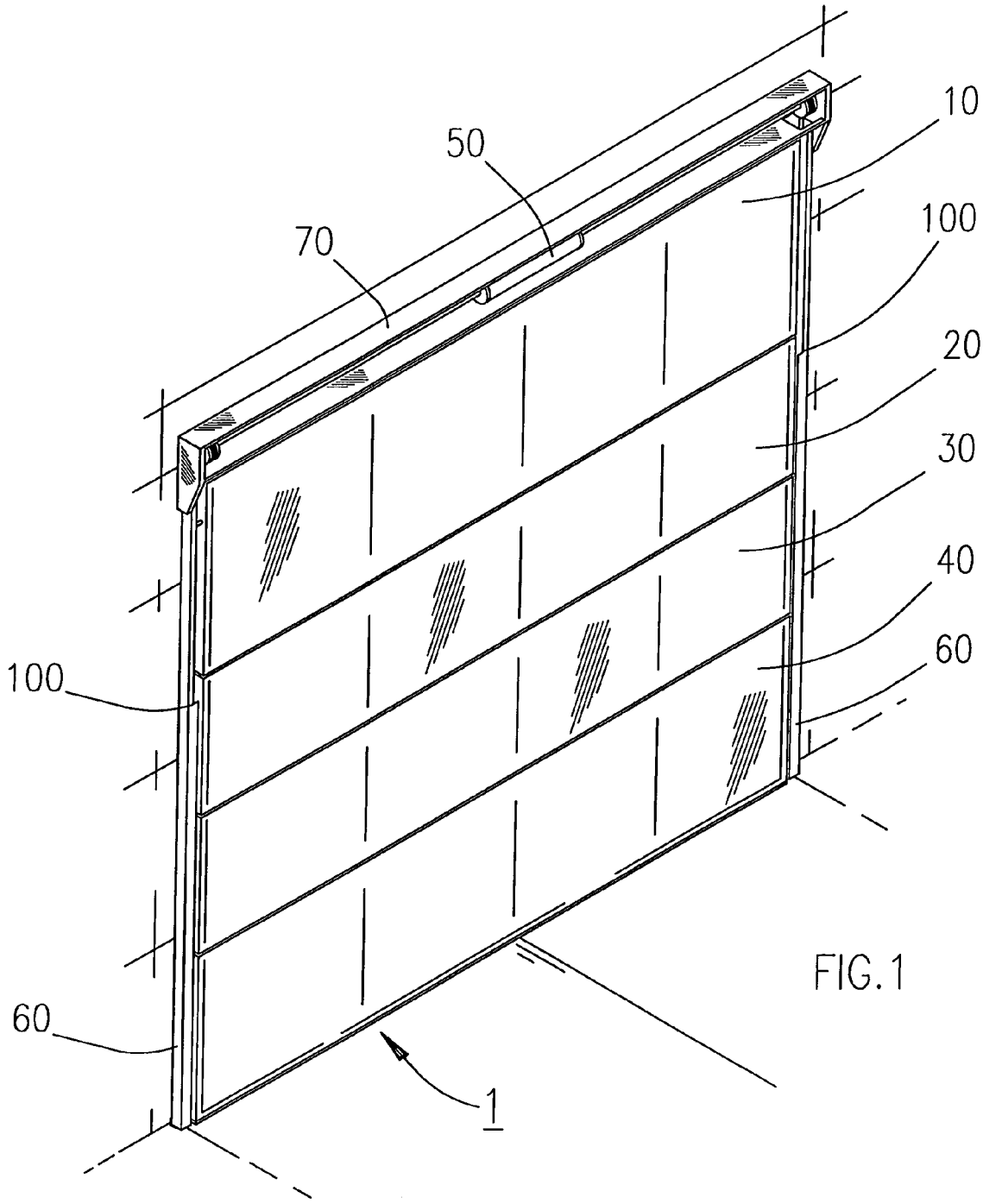
FIG. 1 is a perspective view of a preferred embodiment of the present invention, a folding door apparatus as viewed from inside of a building.

In accordance with the present invention, a folding door apparatus of the type for use as a closure for an opening found in garages for homes and other building structures is disclosed. The folding door apparatus is directed to a door apparatus having a plurality of hinged panels such that, when moving upward, the panels are folded in zigzag fashion in primarily a horizontal direction. Specifically, it will be noted in the drawings that the folding door apparatus relates to an apparatus designed to provide an alternative lifting folding door which can be opened and closed with relative ease and at relatively high speeds. In the broadest context, the folding door apparatus of the present invention consists of components configured and correlated with respect to each other so as to attain the desired objective.

FIGS. 1–14 illustrate the preferred embodiment of the folding door apparatus 1 made in accordance of the present invention. As best shown in FIG. 1, the present invention for use in the door opening of a building (not shown), such as a garage door opening. The opening is defined by a horizontal cross member (not shown) and a pair of spaced vertical uprights designated as letter "A" (FIGS. 2–7) extending therefrom.

While the folding door apparatus of the present invention may be operated by electric means known in the art, it will be described and illustrated in the drawings as being operated manually. The folding door apparatus 1, shown in FIG. 1 can include a counter balance spring 52 that could provide torque through drive shaft 50 to reels 71 to help raise the folding door apparatus 1 and to hold it in the raised position. A drive motor (not shown) could also power drive shaft 50 to lift and lower the folding door apparatus 1.

Figure 7:
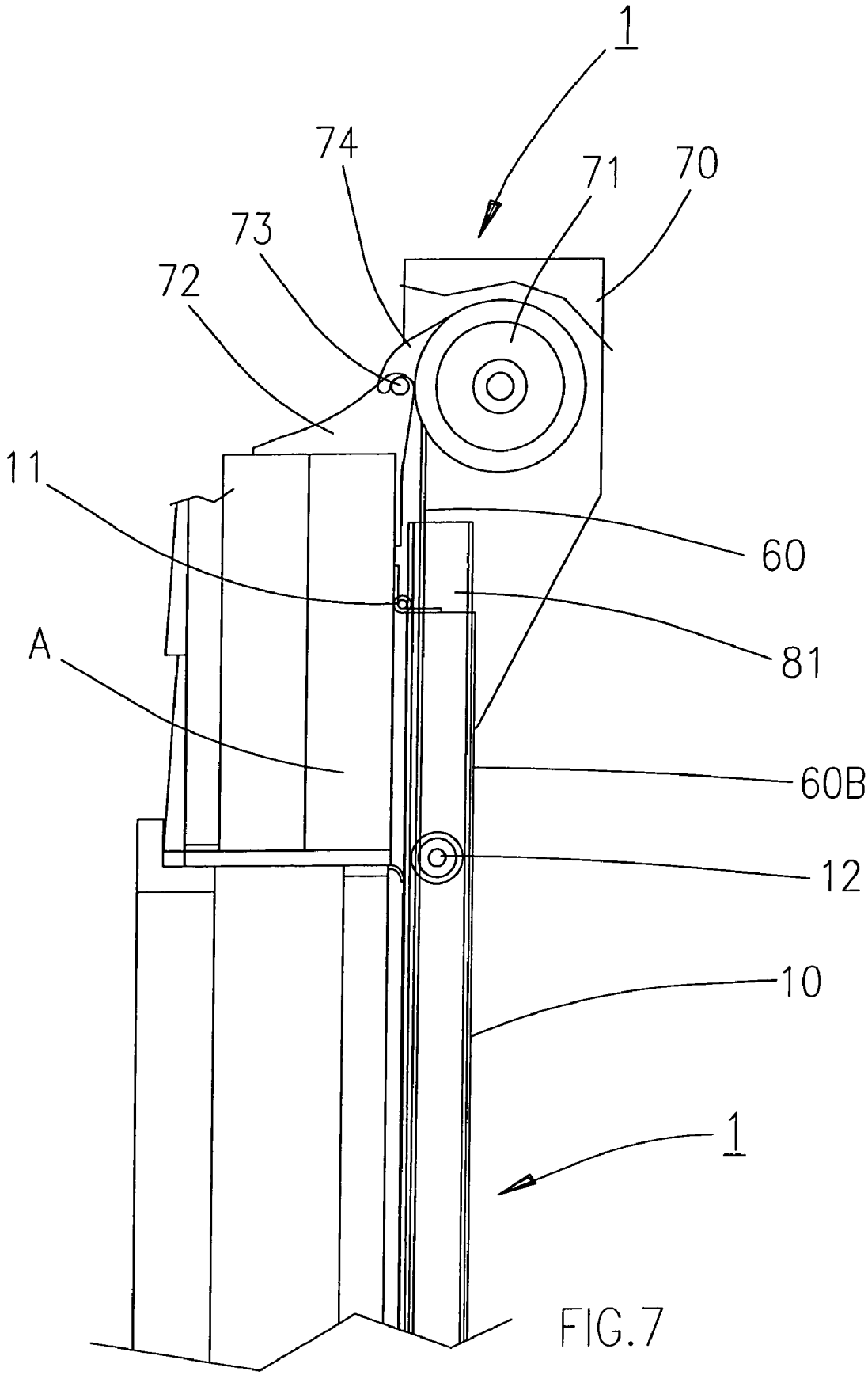
FIG. 7 is a side sectional view of the apparatus of FIG. 1.

As shown in FIG. 7, a pair of cables 81 are wound on a pair of reels 71 to effect opening and closing of the door panels of the folding door apparatus 1. The cable 81 extends vertically along the door panels having a first end (see FIG. 12) connected to door panel 40 (the remotest panel from the reel 71) as will be further described, and an opposite end connected to the reel 71 that is keyed to a drive shaft 50 for unitary rotation therewith.

Figure 3:
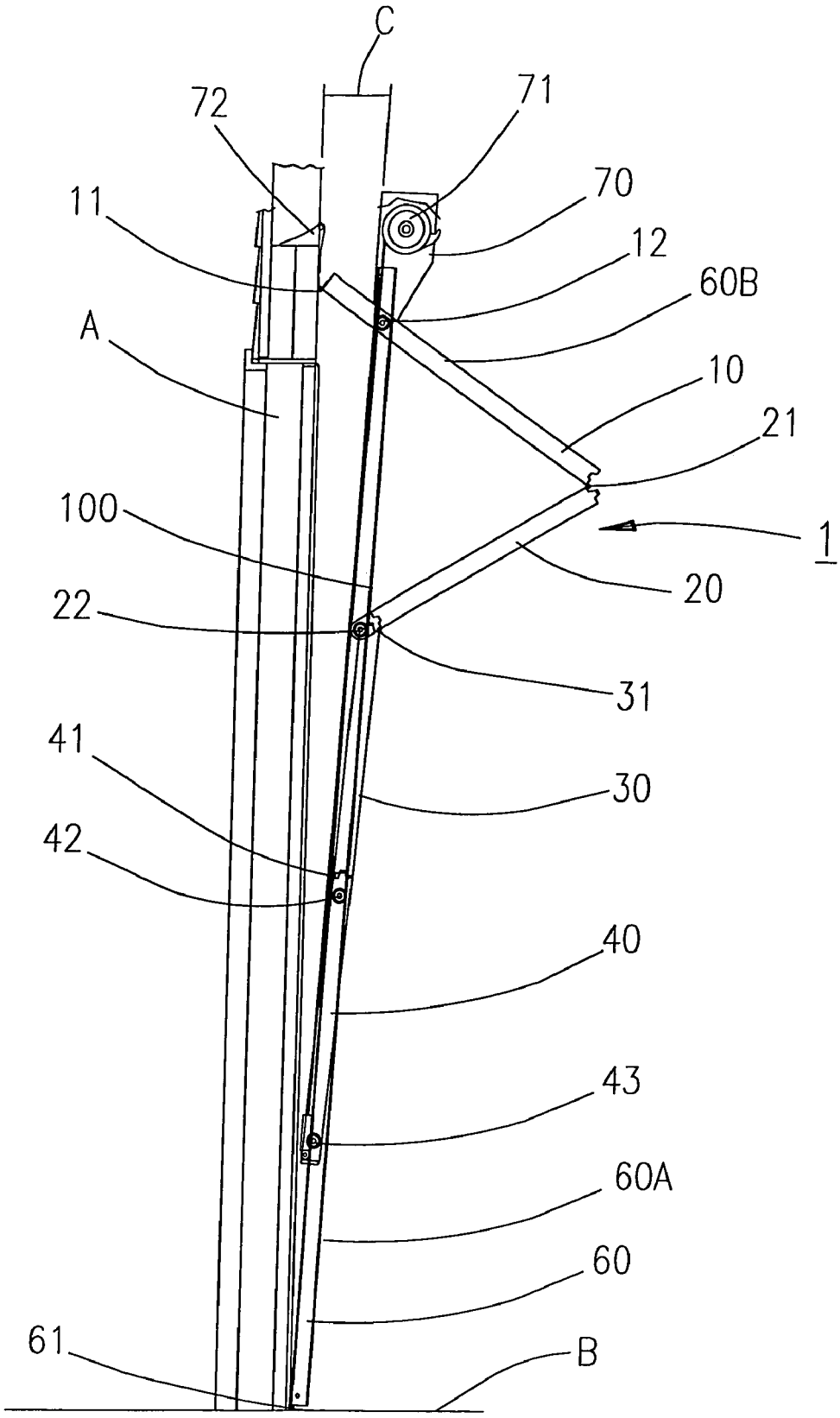
FIGS. 3–5 are side views of the folding door apparatus of FIG. 1 each illustrating the door panel in partially opened positions.
Figure 4:
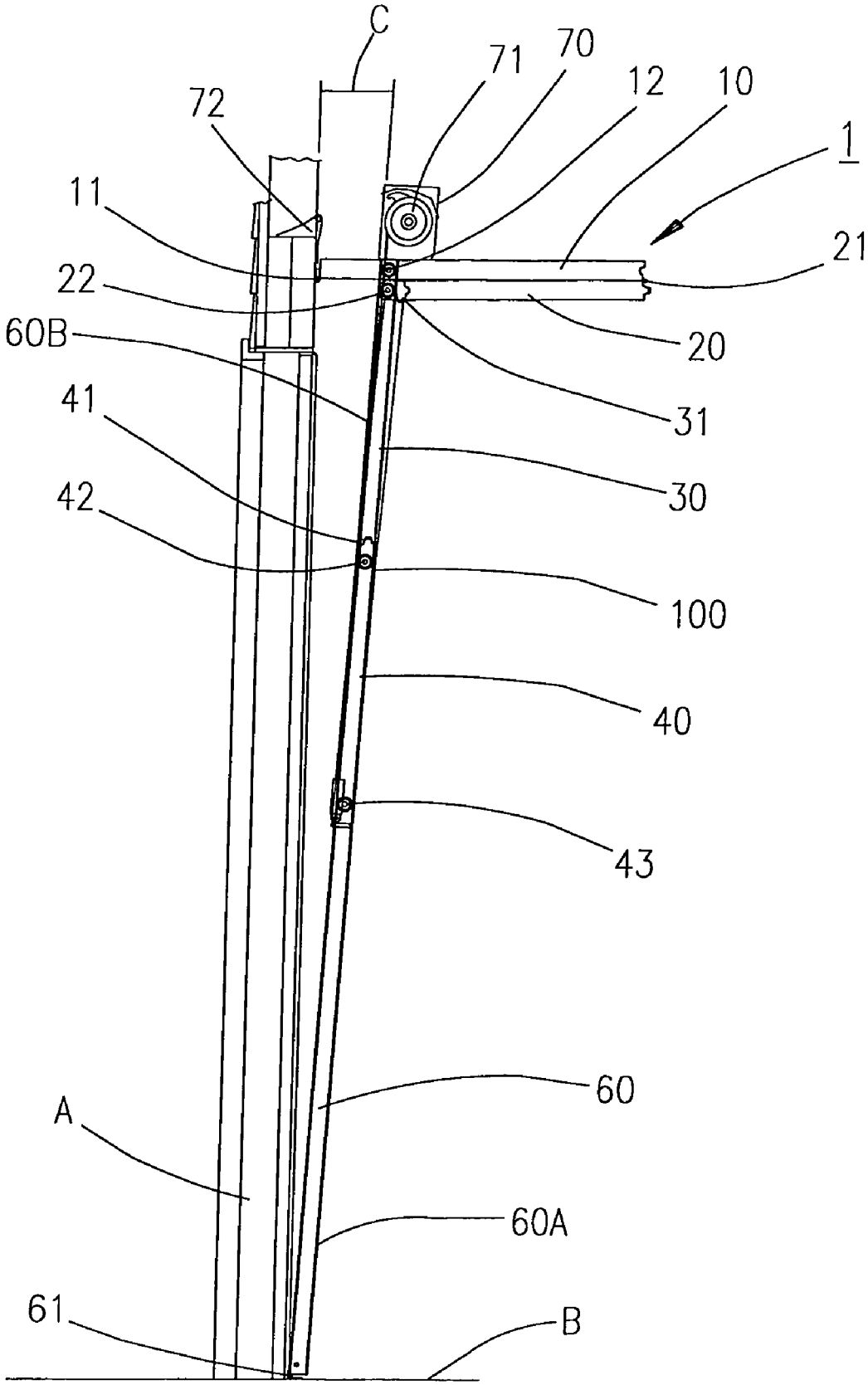
Figure 8:
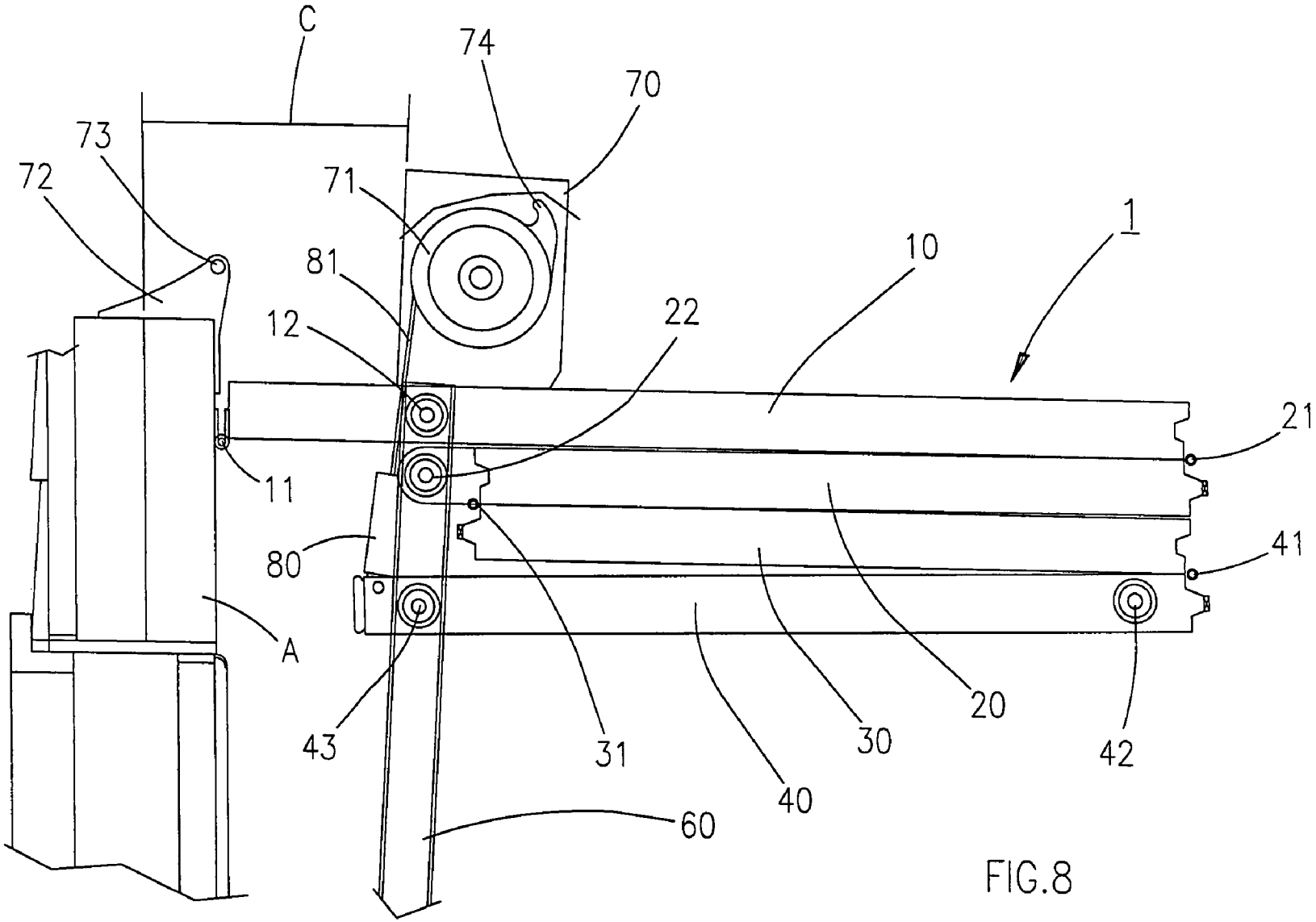
FIGS. 8–9 are side sectional views of the apparatus of FIG. 6.
Figure 9:
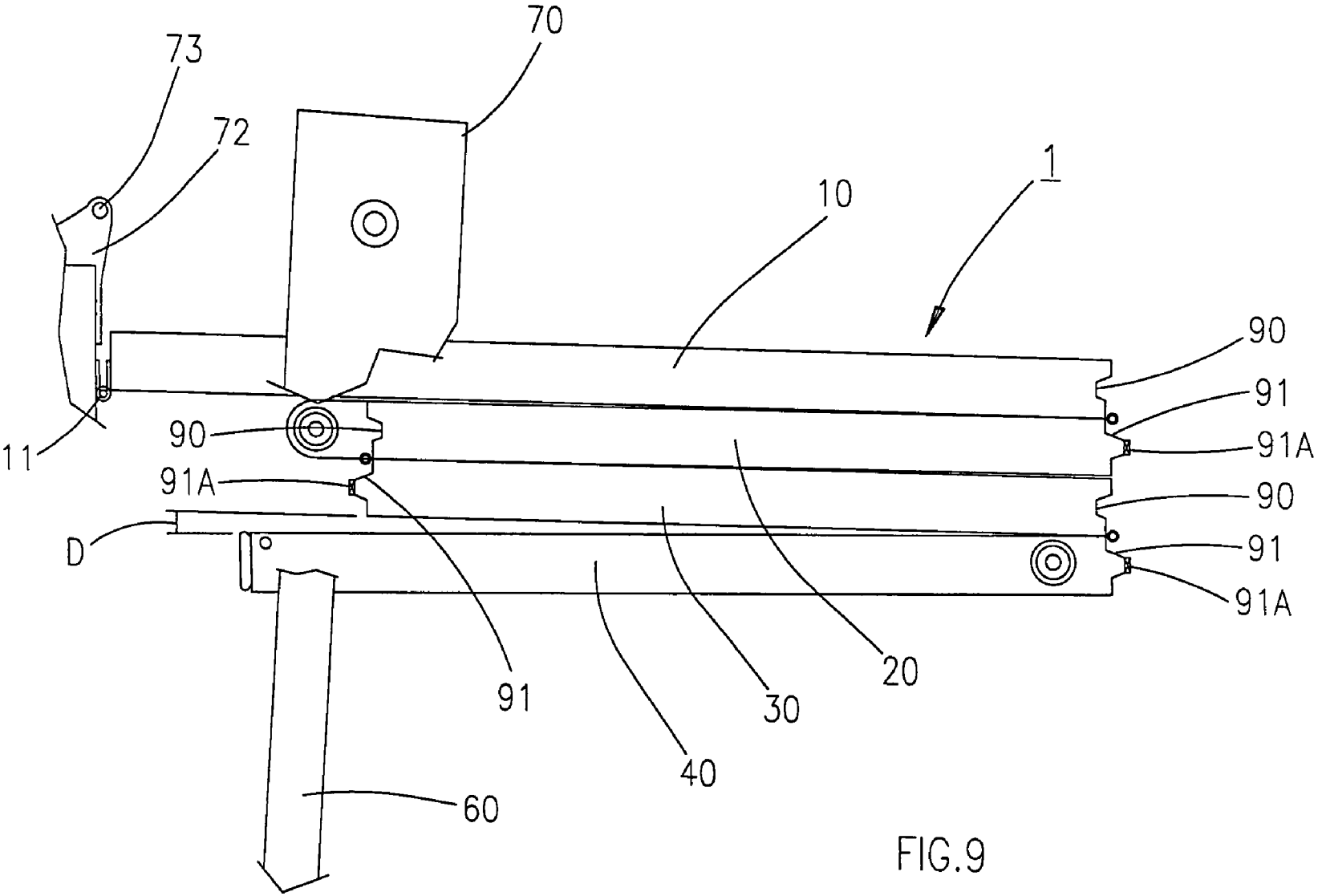
Figure 10:
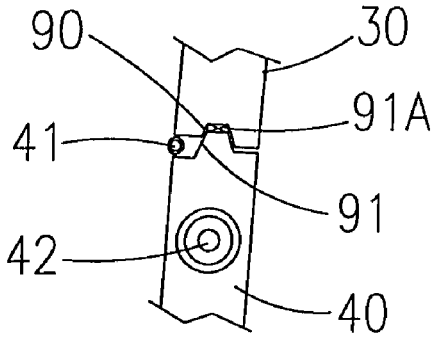
FIGS. 10–11 are side sectional views of a pair of hinged door panels.
Figure 11:
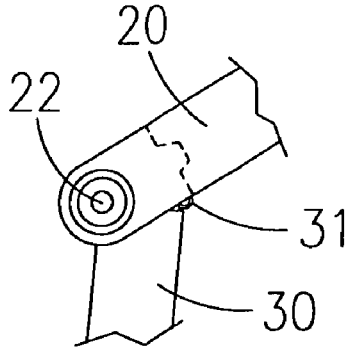

As shown in the drawings, the folding door apparatus 1 includes a plurality of door panels 10, 20, 30, 40. In the drawings, panels are designated 10, 20, 30 and 40. The panels are hinged together with alternate hinges 21, 31, 41 being on the inner side of the panels or on the outer side of the panels. In particular, as best shown in FIG. 3, hinge 21 is disposed on the inner sides of panels 10 and 20, hinge 31 is disposed on the outer sides of panels 20 and 30, and hinge 41 is disposed on the inner sides of panels 30 and 40. As a result, panel 10 is pivotally connected to panel 20 along adjacent edges by hinge 21, panel 20 is pivotally connected to panel 30 along adjacent edges by hinge 31 and panel 30 is pivotally connected to panel 40 along adjacent edges by hinge 41. As best shown in FIGS. 8–9, panel 10 is further pivotally connected to the wall surface "A" by hinge 11. Hinge 41 can be any mechanical hinge but could also be a flexible strap or living hinge or any device that allows for relative pivot between the panels.

Figure 5:
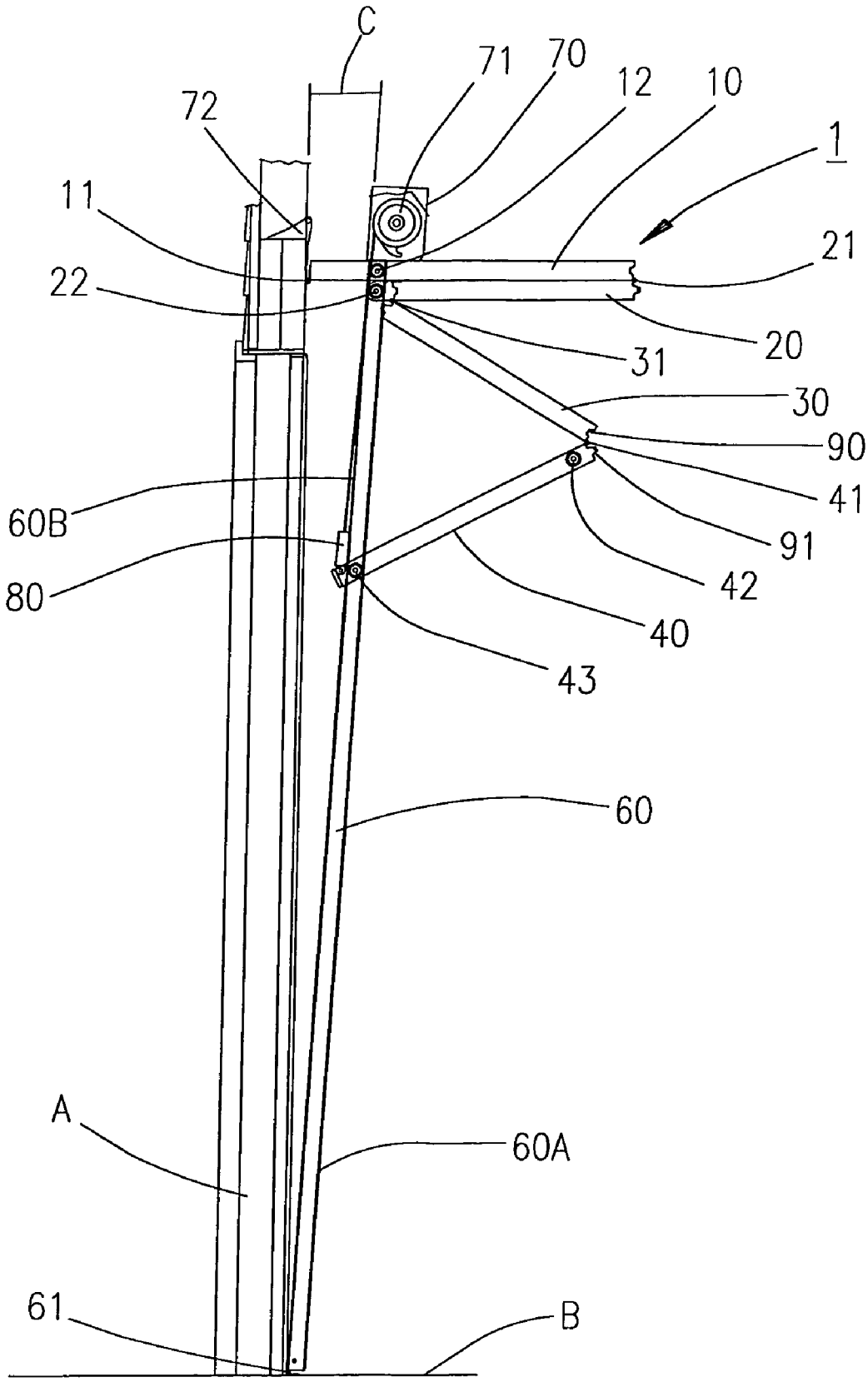

The joining of the panels' adjacent edges as discussed above form an airtight seal between the panels when the folding door apparatus 1 is in the closed position (FIG. 1). As shown in FIG. 9 (also illustrated in FIGS. 3–6 and 8), the panels include a projection portion 91 and a groove portion 90. Two panels are joined (panels 30 and 40 for example, as shown in FIG. 5) when the groove portion 90 of panel 30 mates with the projection portion 91. As shown in FIG. 9, the projection portion 91 can further include a seal 91A to enhance forming the airtight seal between the joined panels.

As will be further described, the apparatus 1 further includes a stability pin 42 and a plurality of guide pin 12, 22 and 43. The stability pin 42 comprising a shaft 42A (see FIG. 14) and a head portion 42B. Each of the guide pins 12, 22 and 43 include a shaft designated as letter "S" (see FIG. 13) and a roller designated as "R". The stability pins 12, 22, 42 and guide pin 43 extend from the outer side edge of selected panels. In particular, guide pin 12 extends from the outer side edge of panel 10, guide pin 22 extends from the outer side edge of panel 30, and guide pin 43 extends from the outer side edge of panel 40. As further illustrated, stability pin 42 likewise extends from the outer side edge of panel 40.

The vertical dimension of the building opening is substantially the same width of the panels 10, 20, 30 and 40, and the spaced area between the vertical uprights "A". As shown in the drawings, the folding door apparatus 1 further includes a guiding system that will be described.

The guiding system of the present invention includes right side components identical to the left side. In the following description of the guiding system, only the components on one side are being described in detail, while the identical components on the opposite are merely being illustrated in the drawings.

The guiding system includes a pair of vertical rails 60 adjacently disposed to the vertical uprights "A". As such, the pair of vertical rails 60 are spaced apart the approximate width of the building opening.

The rail 60 includes a lower end 60A pivotally attached to the structure's floor surface "B" by hinge 61. The rail 60 further includes an upper end 60B that is affixed to mounting bracket 70. As shown in FIG. 1, apparatus' drive shaft 50 is further attached to the bracket 70. The bracket 70 for maintaining proper spacing between the upper ends 60B of the rails 60 and for providing further support thereto.

Figure 13:
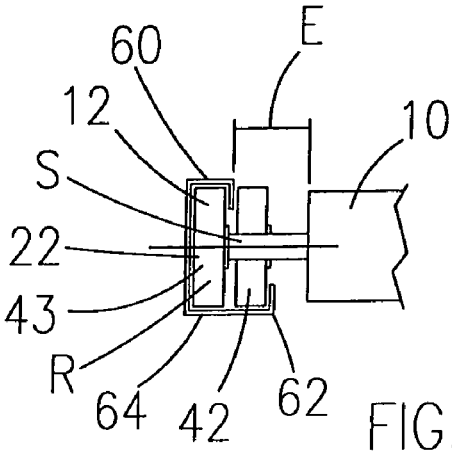
FIG. 13 is a top sectional view of the guiding system of the apparatus of FIG. 1.

As shown in FIG. 1, the rail 60 vertically extends the length of the apparatus 1. Referring to FIG. 13 which illustrates a top view of the rail 60, the rail 60 defines an inner railway 62 and an outer railway 64. As shown in FIG. 13, the outer railway 64 is disposed a distance "E" from the outer side edge of the panel.

The inner railway 62 is designed for receipt of the head portion 42B of stability pin 42. The outer railway 64 is designed for receipt of the roller portions "R" of the guide pins 12, 22 and 43. Of course, each of the panels include a corresponding stability pin and guide pins positioned at the other side edge of the door opening and engaged in the corresponding rail 60.

The head portion 42B of the stability pin 42 is sized to be slidingly received within the inner railway 62, and the roller portions "R" of the guide pins 12, 22 and 43 are sized to be slidingly received within the outer railway 64.

The rail 60 defines the outer railway 64 that vertically extends along the length of the rail 60. The inner railway 62 vertically extends from the lower end 60A of the rail 60 to a release point 100 (best shown in FIG. 14) at the approximate midway of the rail 60. As stated, the inner railway 62 defines a path of travel for the stability pin 42 as long as the stability pin 42 remains engaged with the inner railway 62.

In application raising the door panels to an open position, the stability pin 42 remains engaged within the inner railway 62 (see FIGS. 2–4) until stability pin 42 is raised to the release point 100. At release point 100 the stability pin 42 is disengaged from inner railway 62 for proper folding of the panels as shown in FIG. 5. As should be understood, the guiding pins 12, 22 and 43 remain engaged within the outer railway 64 during opening and closing the door panels. The stability pin 42 when in position as described above provides stability to the door panels to avoid the panels being pushed inward or outward when the door is in the lowered position. The stability pin 42 does not assist in proper tracking of the door when being raised or lowered.

Figure 2:
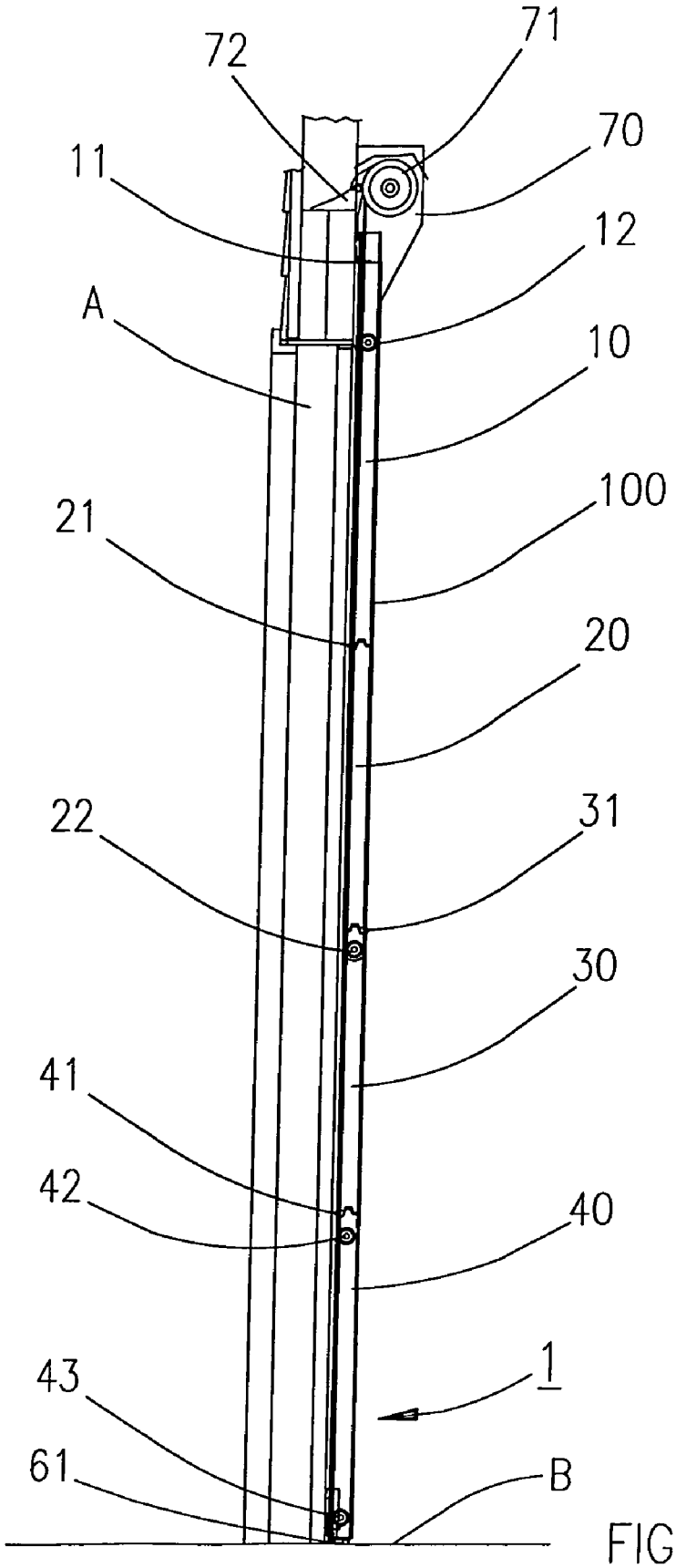
FIG. 2 is a side view of the folding door apparatus of FIG. 1.

In the closed position as shown in FIGS. 1–2 the rails 60 are substantially adjacent the vertical uprights "A". Referring to FIGS. 3–6, as the door panels are raised the rails 60 and the mounting bracket 70 (attached to the rails 60) pivot a distance "C" from the vertical uprights "A". Rails 60 outwardly pivot by hinge 61. Hinge 61 releases the rails 60 to pivot not more than distance "C", preferably about 6.4 inches. Pivoting the upper end 60B of the rails 60 outward during the raising operation as discussed assists in the stacking of the panels and further assists the stability pin 42 to properly release outward once it passes the release point 100.

Referring to FIG. 7, the reel 71 includes a hook member 74 that can engage a catch 73 disposed on a mount 72 that is affixed to the vertical upright "A". In particular, hook member 74 has a first engaging position as shown in FIGS. 2 and 7 when the door panels are in the closed position, and a second disengaging position as shown in FIGS. 3–6 and 8 when the door panels are being raised or in the open position and the rails 60 are pivotally separated from the vertical upright A as discussed. In the first engaging position the reel 71 is stopped from rotating or un-winding the cable 81 which would cause undesired slack in the cable line 81.

Figure 12:
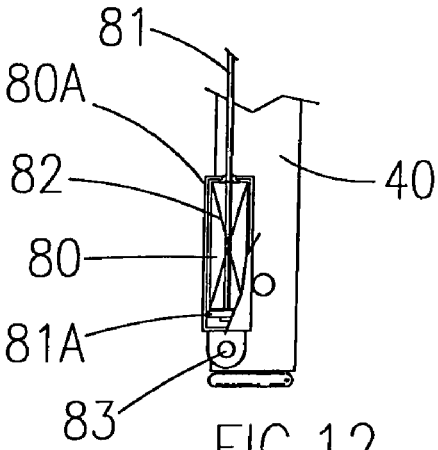
FIG. 12 is a side sectional view of the guiding system of the apparatus of FIG. 1.
Figure 14:
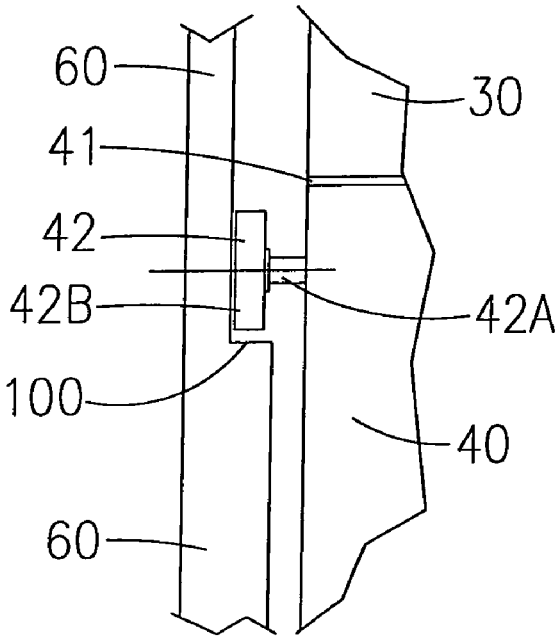
FIG. 14 is a sectional view of the guiding system of the apparatus of FIG. 1, as viewed from inside of a building.

As stated, an end of cable 81 is attached to door panel 40 with connector means. Referring to FIG. 12, the end of the cable 81 is attached to a compressing plate 81A disposed within a housing 80. The housing 80 is attached to the door panel 40 with connector 83. A spring 82 is further disposed within the housing 80 sandwiched between the compressing plate 81A and an upper surface 80A of the housing 80. The spring 82 is in a substantially open condition (shown in FIG. 12) when the apparatus 1 is in the open or raised position, and is in a compressed condition, where the compressing plate 81A is pushed towards the upper surface 80A of the housing 80, when the apparatus 1 is in the closed or lowered position. The connecting means including the connector 83, housing 80, compressing plate 81A and spring 82 as described, further assists in maintaining tension of the cable 81 as the door panels of the apparatus 1 open and/or close.

Figure 6:
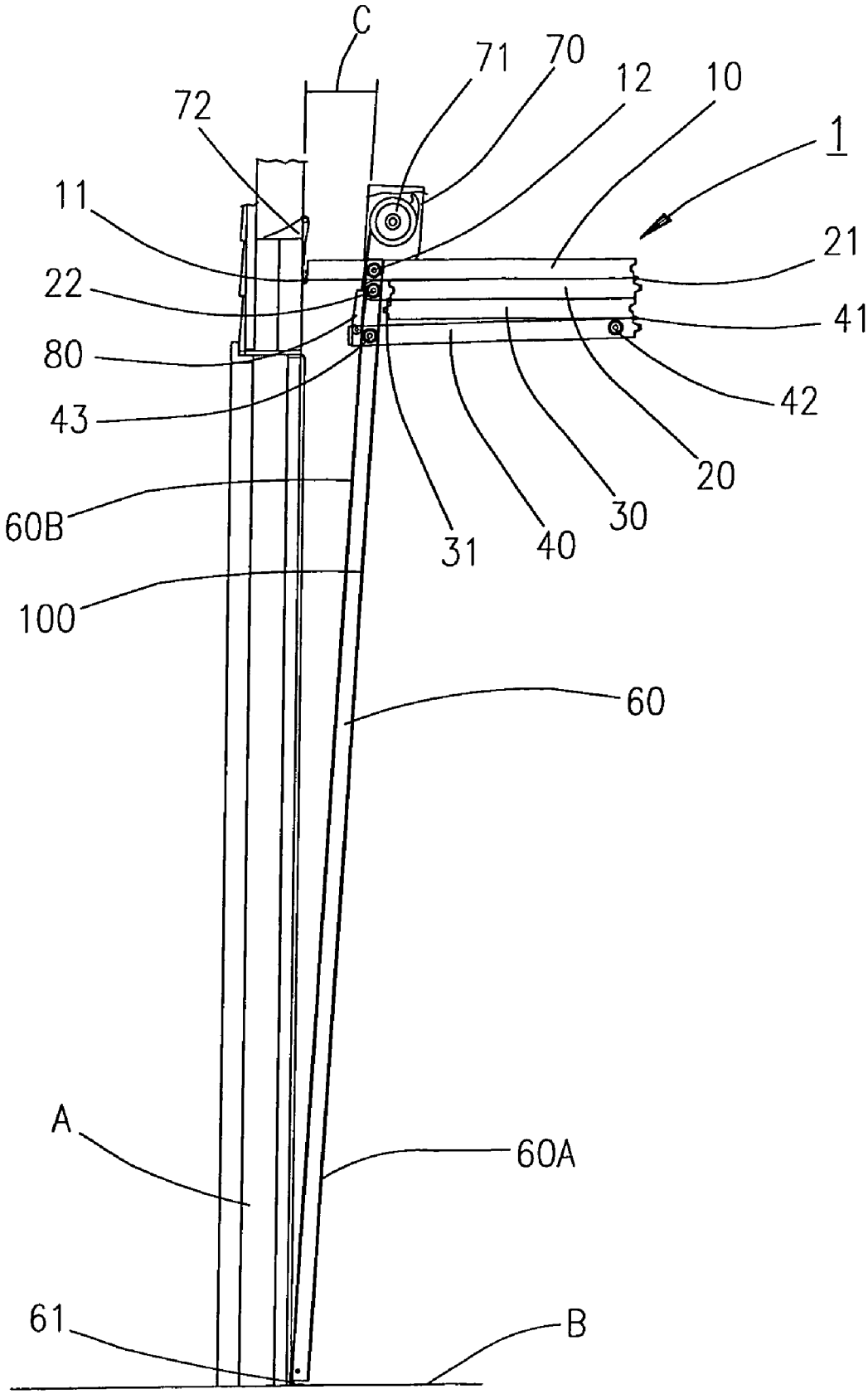
FIG. 6 is a side view of the folding door apparatus of FIG. 1 illustrating the door panel in an open position.

The relative position of the door panels and their components are represented in FIG. 1 when the apparatus 1 is in its closed or lowered position and, is represented in FIG. 6 when the apparatus 1 is in it open or stacked position.

To commence a door opening operation, urging the panels upward disengages the hook member 74 from the catch 73 whereupon the reels 71 can rotate in a cable winding direction. The cables 81 are thus retracted onto their respective reels 71 causing upward movement of the panels by the upward force exerted.

During initial upward movement of the door apparatus 1, as shown in FIG. 3, the rails 60 pivot distance "C" from the vertical uprights "A", and door panel 10 immediately outwardly pivots on hinge 11. As panel 10 pivots upward as shown, panel 10 and panel 20 fold at the hinged location into a horizontal position for stacking purposes. Panels 30 and 40 continue to move vertically as a unit as the guide pins 22 and 43, and stability pin 42 slidingly engage the tracks 64, 62 respectively.

The continued upward movement of the remotest panels 30 and 40 along the rails 60, such that stability pin 42 is released at release point 100, causes panel 30 to pivot as shown in FIG. 5 at the hinged location connecting panel 30 to panel 40. Once the stability pin 42 is released, and as the panels 30 and 40 are advanced upward, the panels 30 and 40 are folded to a horizontal position as shown in FIG. 6.

In the raised or open position, the reel 71 remains in a disengaged position with catch 72, and the rails 60 maintain the distance "C" from the vertical uprights "A". The door panels of the door apparatus 1 will remain in an overhead stacked and folded position until initiation for a door closing operation whereupon the above sequence of operation is reversed.

An advantage of the folding door apparatus 1 is that it is self contained. The apparatus rail 60 can be attached to a floor with fixed hinge 61, and the fixed hinge 11 attached to an upper point near vertical uprights "A" and the apparatus 1 is ready to use. This is considerably simpler than conventional garage door installation.

Although the description above contains many specificities, these should not be construed as limiting the scope of the invention but as merely providing illustrations of some of the presently preferred embodiments of this invention. As such, it is to be understood that the present invention is not limited to the embodiments described above, but encompasses any and all embodiments within the scope of the claims.

It will be obvious to those skilled in the art that modifications may be made to the embodiments described above without departing from the scope of the invention. Thus the scope of the invention should be determined by the claims in the formal application and their legal equivalents, rather than by the examples given.

I claim:

1. A folding door panel apparatus comprising:

a plurality of panels connected together with hinges, a pair of winding reels and cables, a pair of vertical rails, wherein an upper end of the rails pivot a distance from a structure's vertical uprights, wherein the panels are positioned between the vertical rails, wherein the rails include an outer railway that extends the length of the rail, wherein the rails further include an inner railway disposed parallel with the outer railway, said inner railway extends from a lower end of the rail to a release point, a stability pin extending from an outer edge of one of the panels in sliding engagement with the inner railway, a plurality of guide pins extending from the outer edge of selected panels in sliding engagement with the outer railway, connecting means to connect the cables to one of the panels, and wherein said plurality of panels include a first panel having a first fixed hinge point attachable to the structure and said rails include a second fixed hinge point attachable to the structure such that said rails pivot as said folding door moves from an open position to a closed position.

2. The folding door apparatus as recited in claim 1, wherein the plurality of door panels comprises said first panel, a second panel, a third panel and a fourth panel.

3. The folding door apparatus as recited in claim 2, wherein the stability pin extends from the outer edge of the fourth panel.

4. The folding apparatus as recited in claim 2, wherein the cable is connected to the fourth panel.

5. The folding apparatus as recited in claim 1, wherein the connecting means comprising a plate disposed within a housing, said housing attached to the fourth panel, a spring sandwiched between the plate and an upper surface of the housing, wherein the cable is connected to the plate.

6. The folding door apparatus as recited in claim 5, wherein the spring has an open condition when the door apparatus is in a raised position, and a compressed condition when the door apparatus is in a closed position.

7. The folding door apparatus as recited in claim 1, wherein a first outer end of the panels include a projection portion and an opposite outer end of the panels include a groove portion, wherein an airtight seal is formed between a pair of panels when the groove portion of the first panel joins with the projection portion of the second panel.

8. The folding door apparatus as recited in claim 7, wherein a seal is disposed on the projection portion.

9. The folding door apparatus as recited in claim 1, wherein the hinges are alternately disposed on inner and outer sides of the panels along adjacent edges.

10. The folding door apparatus as recited in claim 3, wherein the stability pin comprises a shaft portion that extends from an outer edge of the panel, and a head portion attached to the shaft portion, said head portion in sliding engagement with the inner railway.

11. The folding door apparatus as recited in claim 1, wherein the guide pin comprises a shaft portion that extends from an outer edge of the selected panels, and a roller portion attached to the shaft portion, said roller portion in sliding engagement with the outer railway.

12. A folding door panel apparatus comprising:

a top panel, a second panel, a third panel and a bottom panel, said second and third panels disposed between the top and bottom panels, said panels connected together with hinges, a pair of winding reels and cables, a pair of vertical rails, wherein an upper end of the rails pivot a distance from a structure's vertical uprights, wherein the panels are positioned between the vertical rails, wherein the rails include an outer railway that extends the length of the rail, wherein the rails further include an inner railway that extends from a lower end of the rail to a release point, a stability pin extending from an outer edge of the bottom panel, said stability pin in sliding engagement with the inner railway, a plurality of guide pins extending from the outer edge of said top, second and bottom panels in sliding engagement with the outer railway, connecting means to connect the cable to the bottom panel, and wherein said top panel includes a first fixed hinge point attachable to said structure and said rails include a second fixed hinge point attachable to the structure such that said rails pivot as said folding door move from an open position to a closed position.

13. The folding apparatus as recited in claim 12, wherein the connecting means comprising a plate disposed within a housing, said housing attached to the bottom panel, a spring sandwiched between the plate and an upper surface of the housing, wherein the cable is connected to the plate.

14. The folding door apparatus as recited in claim 12, wherein a first outer end of the panels include a projection portion and an opposite outer end of the panels include a groove portion, wherein an airtight seal is formed between a pair of panels when the groove portion of one of the panels join with the projection portion of the other panel.

15. The folding door apparatus as recited in claim 14, wherein a seal is disposed on the projection portion.

16. The folding door apparatus as recited in claim 12, wherein the hinges are alternately disposed on inner and outer sides of the panels along adjacent edges.

17. The folding door apparatus as recited in claim 12, wherein the stability pin comprises a shaft portion that extends from an outer edge of the bottom panel, and a head portion attached to the shaft portion, said head portion in sliding engagement with the inner railway.

18. The folding door apparatus as recited in claim 12, wherein the guide pin comprises a shaft portion that extends from an outer edge of the panels, and a roller portion attached to the shaft portion, said roller portion in sliding engagement with the outer railway.

19. A folding door panel apparatus comprising:

a plurality of panels connected together with hinges, at least one winding reel and cable, at least one pivotable vertical rail, wherein the panels are connected to the at least one pivotable vertical rail, wherein the rail includes an outer railway that extends the length of the rail, wherein the rail further includes an inner railway disposed parallel with the outer railway, said inner railway extends from a lower pivot end of the rail to a release point, a stability pin extending from an outer edge of one of the panels in sliding engagement with the inner railway, a plurality of guide pins extending from the outer edge of selected panels in sliding engagement with the outer railway, a connector connecting the cable to one of the panels, wherein said plurality of panels include an upper panel and a lower panel and wherein said upper panel includes a first fixed hinge point attachable to a structure and said pivotable vertical rail includes a second fixed hinge point attachable to the structure such that said pivotable vertical rail pivots as said folding door moves from an open position to a closed position.

* * * * *